US012054938B2

(12) United States Patent
Scherrer et al.

(10) Patent No.: US 12,054,938 B2
(45) Date of Patent: Aug. 6, 2024

(54) VENTED INSULATION UNIT AND SYSTEM

(71) Applicants: Edward G. Scherrer, Mitchell, SD (US); Andrew Robert Scherrer, Mitchell, SD (US)

(72) Inventors: Edward G. Scherrer, Mitchell, SD (US); Andrew Robert Scherrer, Mitchell, SD (US)

( * ) Notice: Subject to any disclaimer, the term of this patent is extended or adjusted under 35 U.S.C. 154(b) by 377 days.

(21) Appl. No.: 17/311,620

(22) PCT Filed: Dec. 6, 2019

(86) PCT No.: PCT/US2019/064880
§ 371 (c)(1),
(2) Date: Jun. 7, 2021

(87) PCT Pub. No.: WO2020/118155
PCT Pub. Date: Jun. 11, 2020

(65) Prior Publication Data

US 2022/0018119 A1 Jan. 20, 2022

Related U.S. Application Data

(60) Provisional application No. 62/776,980, filed on Dec. 7, 2018.

(51) Int. Cl.
*E04B 1/76* (2006.01)
*E04F 13/075* (2006.01)
*E04F 13/08* (2006.01)

(52) U.S. Cl.
CPC ..... *E04B 1/7675* (2013.01); *E04F 13/075* (2013.01); *E04F 13/0803* (2013.01);
(Continued)

(58) Field of Classification Search
CPC .... E04B 1/7675; E04B 1/7612; E04F 13/075; E04F 13/0803; E04F 13/0866; E04F 13/0878; E04F 2290/04
See application file for complete search history.

(56) References Cited

U.S. PATENT DOCUMENTS 5,860,259 A * 1/1999 Laska ..... E04B 1/7612 52/404.1
6,594,964 B2 * 7/2003 Charland ..... E04C 3/29 52/302.1

(Continued)

FOREIGN PATENT DOCUMENTS

FR 2 966 180 A1 4/2012

OTHER PUBLICATIONS

International Search Report and Written Opinion of the International Searching Authority for International Patent Application No. PCT/US2019/064880 mailed Mar. 27, 2020, 14 pages.

*Primary Examiner* — Rodney Mintz
(74) *Attorney, Agent, or Firm* — Merchant & Gould P.C.

(57) ABSTRACT

A wall insulation system includes a plurality of insulation elements extending along a longitudinal direction. First insulation elements include a first portion proximate a second portion, the first portion having a width greater than the second portion, the first portion having a first face, the first face having grooves formed into the first face. The grooves extend obliquely to the longitudinal direction. A longitudinally extending mounting member is embedded in the first insulating element.

10 Claims, 13 Drawing Sheets

(52) U.S. Cl.
CPC ..... *E04F 13/0866* (2013.01); *E04F 13/0878* (2013.01); *E04F 2290/04* (2013.01)

(56) References Cited

U.S. PATENT DOCUMENTS

| | | | | |
|---|---|---|---|---|
| 7,712,276 | B2 * | 5/2010 | Gilbert | B32B 13/12 52/529 |
| 8,635,824 | B2 * | 1/2014 | Scherrer | E04B 1/7675 52/309.7 |
| 9,434,131 | B2 * | 9/2016 | Morse | E04F 13/0871 |
| 10,773,882 | B2 * | 9/2020 | Scherrer | E04B 1/3483 |
| 2002/0026762 | A1 * | 3/2002 | Charland | E04C 3/29 52/302.1 |
| 2006/0068188 | A1 * | 3/2006 | Morse | E04F 13/0866 428/317.1 |
| 2008/0168728 | A1 * | 7/2008 | Scherrer | E04B 1/80 52/592.2 |
| 2010/0319288 | A1 | 12/2010 | Morse et al. | |
| 2011/0252728 | A1 | 10/2011 | Scherrer | |
| 2013/0247493 | A1 * | 9/2013 | Culpepper | E04F 13/141 52/309.4 |
| 2018/0273291 | A1 | 9/2018 | Scherrer et al. | |
| 2022/0018118 | A1 * | 1/2022 | Scherrer | E04B 1/7675 |

* cited by examiner

VENTED INSULATION UNIT AND SYSTEM

This application is a National Stage Application of PCT/US2019/064880, filed Dec. 6, 2019, which claims priority to U.S. Provisional patent application Ser. No. 62/776,980, filed Dec. 7, 2018, the entire disclosures of which are incorporated by reference in their entireties. To the extent appropriate, a claim of priority is made to each of the above disclosed applications.

BACKGROUND OF THE INVENTION

Field of the Invention

The present invention is directed to an insulation system and in particular to a finishing system having insulating assemblies fitted together for mounting onto walls or other building structures and providing insulation, venting and moisture drainage.

Description of the Prior Art

Wall systems for conventional frame type construction, basements and other applications wherein a masonry, concrete modular unit (CMU) or poured concrete wall are often used in conjunction with traditional wood framed construction with studs and with rolled fiberglass insulation placed against the concrete block or other masonry between the studs. Such construction systems are well known and utilized widely.

Although such systems have proven to be suitable and often provide satisfactory finishing, such systems have several drawbacks. Conventional mounting of studs to a concrete wall is difficult and has weaknesses. The studs may warp or twist and may cause the nails to protrude back through drywall. The wood studs are prone to mold, moisture damage and rot that require an additional vapor barrier. Although insulation may be placed between the studs, the studs and in particular, the mounting nails are a thermal conductor. Steel studs are an alternative, but generally prove difficult for the average homeowner to install, require special mounting and suffer from high thermal conductivity through the depth of the wall and may also rust and/or corrode.

Fiberglass insulation is also susceptible to water damage and mold if moisture is present. The thickness required for adequate insulation may decrease the overall size of the room due to the added depth of the wall. Fiberglass insulation is difficult to handle and requires special gloves and a respirator. Foam types of insulation are often open cell material that allows moisture to pass through, but is able to vent air and drain moisture.

Common stud and rolled fiberglass insulation systems also suffer from difficult installation required for wiring, switches, tubing and other components. Conventional construction requires drilling through the studs to create openings for routing wiring and/or tubing along the wall.

To overcome the problems associated with common stud construction, systems have been developed to provide an insulation layer. Such systems typically use panels that may attach to one another. Some panels may include metal studs formed therein to allow for mounting. Although such systems do provide advantages in many applications over traditional construction, these systems suffer from their own disadvantages. Such systems may use unwieldy, large panels and do not provide alignment along edges. In addition, such systems do not provide for quick and simple mounting using traditional techniques such as screws or glue strips. Moreover, such systems do not provide for drains or channels to allow air and water to vent and/or to drain. Such systems may also suffer from difficult installation of wiring, tubing and other elements that are installed within the wall.

A common problem with construction arises related to on center spacing of studs. Studs are often interrupted for interior intersection walls, such as when windows are placed. Prior systems not have the versatility to match up with existing studs or around windows when on center spacing varies, which may be needed for siding attachment. Moreover, large molded panels have the on center spacing is molded into the panel.

It can be seen then that a new and improved insulation system and mounting is needed. Such a system should provide simple, lightweight, inexpensive and easy to install construction. Such a system could serve as continuous insulation when installed over conventional frame type construction or masonry/concrete. Such a system should have mounting studs in some elements recessed in the foam materials to minimize/eliminate thermal bridging. In addition, such a system should provide for easily routing tubing, wiring and other components into the wall or other structure. Such a system should be versatile to match up with existing studs or around windows when on center spacing varies. Thermally conductive elements extending at select points through the insulation layer should be eliminated to provide improved insulation over the entire area. Mounting of drywall, paneling or other layers should be easily accomplished with variable spacing of mounting elements with conventional mounting hardware extending into, but not through, the mounting assemblies to thermally isolate the thermal conductor hardware and prevent formation of thermally conductive paths through the wall. Mounting assemblies should be compatible with different types of other insulation including blown insulation, fiberglass, spray, rolled and other types of friction fit insulation or any cavity insulation. In addition to insulating, such a system should provide for venting air and draining moisture while relieving hydrostatic pressure. Such a system should provide for ventilation around openings in the wall, such as windows and doorframes, and should allow venting into soffits or behind trim. Channels for drainage and venting should be chamfered to direct moisture away from cladding. The mounting assemblies should be usable with insulation placed over and/or under the mounting assemblies. Such a system should act as a rain screen to prevent suction of moisture inward and as a vapor throttle to prevent moisture from being driven inward while also maintaining the temperature above the dew point in cold climates to eliminate internal condensation. The present invention addresses these problems, as well as others associated with insulation systems.

SUMMARY OF THE INVENTION

The present invention is directed to an insulation unit and a wall insulation system, and in particular to a wall finishing system suitable for wood or steel frame walls, concrete, CMU, masonry and other similar wall construction. The present invention utilizes foam insulating units that are used in conjunction with conventional insulation to form an insulation layer in a wall. The units include mounting studs embedded into the insulation units to reduce cost and to eliminate problems associated with conventional insulation systems and provide improved ventilation and drainage within a wall system.

According to the present invention, a wall portion is covered by an insulating layer and then an inner finishing layer that may be painted, wallpapered, paneled or finished using other well-known techniques and/or an outer layer such as siding, stucco or other common outer layers that may form a rain screen. For some climates and applications, the rain screen may be formed from the insulating units and appropriate mounted to the structural portion of the wall and covered by stucco, siding or other outer protective layers.

The units have stud-type mounting elements embedded in the foam that allow for fastening with glue and conventional hardware to the wall. The mounting elements also provide for attachment of drywall, wood paneling, siding and other finishing type layers to the insulating layer. The insulation units are generally made of water impervious foam material so that the units are lightweight and easily transported. In typical embodiments, the units have a first face of a first portion that is 5.5 inches wide overall and a rear portion that is 4 inches wide with the unit being 2.75 inches deep. The units are typically mounted with the longitudinal axis extending vertically and have a working height of 24 inches with a tongue extending 0.5 inches from one end. However, other size units may be used for other applications and requirements. Each insulation unit has a tongue at one end and a complementary groove at the second end configured to receive the tongue of an adjacent unit to ensure a proper engagement and alignment vertically. The wider front portion forms an inner corner with a narrower rear portion that is configured to receive conventional insulation panels.

The insulation unit includes a first face on the front portion having angled channels formed into and extending across the first face. The channels generally extend at an oblique angle relative to the longitudinal axis and provide a plurality of slanted channels extending across the first face of the insulation units. The channels have a chamfered lower surface that provides for water to be directed generally outward and prevents water from moving into the wall. In this manner, damage due to moisture is minimized or eliminated.

The stud type mounting elements are molded into and embedded within the foam portion. In one embodiment, the studs are generally elongate members with a somewhat "H" shaped cross-sectional profile. The first portion extends perpendicularly outward from its center, which abuts a series of center connecting ribs. The second portion extends from an opposite end of the connecting ribs in a substantially perpendicular configuration. The first portion is spaced inward from a first face of the unit and includes a channel or channels to receive mounting hardware used to attach other wall layers to the insulation units. The second portion of the stud extends to a second face of the insulation unit and includes laterally extending ridges that are configured to receive adhesive. The insulation units are glued to a structural wall with adhesive or mounting hardware secured to the stud. Adhesive holds the insulation units in tension and eliminate any shrinkage. As the insulation units do not shrink when glued in place, there are no gaps and no need for placing tape over the gaps. The embedded studs are preferably molded of plastic material with low thermal conductivity that is impervious to rusting and other deterioration and that can provide a foundation for attaching mounting hardware and also provide support for the unit. The studs are made of plastic that eliminates galvanic deterioration when attaching dissimilar metals such as aluminum cladding being joined to steel framing. The studs eliminate the need for hardware that extends entirely through the insulation layer and therefore eliminates thermal conduits extending through the insulation layer and improves insulation.

The wall system is easily installed using conventional mounting methods. The insulation units are typically installed by gluing or with conventional mechanical fasteners to the wall, such as poured concrete, concrete masonry unit construction or traditional wood or steel framing. Moreover, once installed further layers may be easily attached to the embedded stud using conventional fasteners and methods.

The insulation units with slanted channels provide pathways that allow for ventilation to extend vertically within the wall system. Moreover, the slanted channels also provide angled cross ventilation to move air across and upward through the wall system. The same angled channels, along with the longitudinal spaces formed by angled portions, ridges and notches in the insulation units allow moisture to flow downward under gravity within the wall system. The lowermost insulation units and corresponding insulation panels generally are installed with a gap at the lower portion of the wall to allow moisture to disperse. In this manner, the wall system is able to provide ventilation and to eliminate internal moisture buildup within the wall system. It can also be appreciated that the materials used in the insulation layer are water resistant and will not rot and will facilitate resistance to mold. It can also be appreciated that the insulation system eliminates thermal pathways extending through the insulation layer.

The present invention is lightweight, durable, easy to install, long lasting, has improved insulation attributes, is inexpensive, can be used for retrofit applications and minimizes common drawbacks of traditional construction such as mold, water damage and other problems associated with the prior art. The system uses insulation units that fasten to a conventional wall and are easy to cut with conventional cutting tools, such as used for cutting foam or wood, for individually sizing the units or cutting additional chases or channels as the units do not have a metal layer or other material that is difficult to cut. The units have built in slanting channels for ventilation and drainage. The channels create a vacuum as warm air rises to promote cross flow ventilation that is beneficial above and below openings. The channels and vacuum eliminate the need for complex detailing need to provide intake and exhaust ventilation above and/or below openings in the wall.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring now to the drawings, wherein like reference numerals and letters indicate corresponding structures throughout the several views.

DETAILED DESCRIPTION OF THE PREFERRED EMBODIMENT

Figure 1:
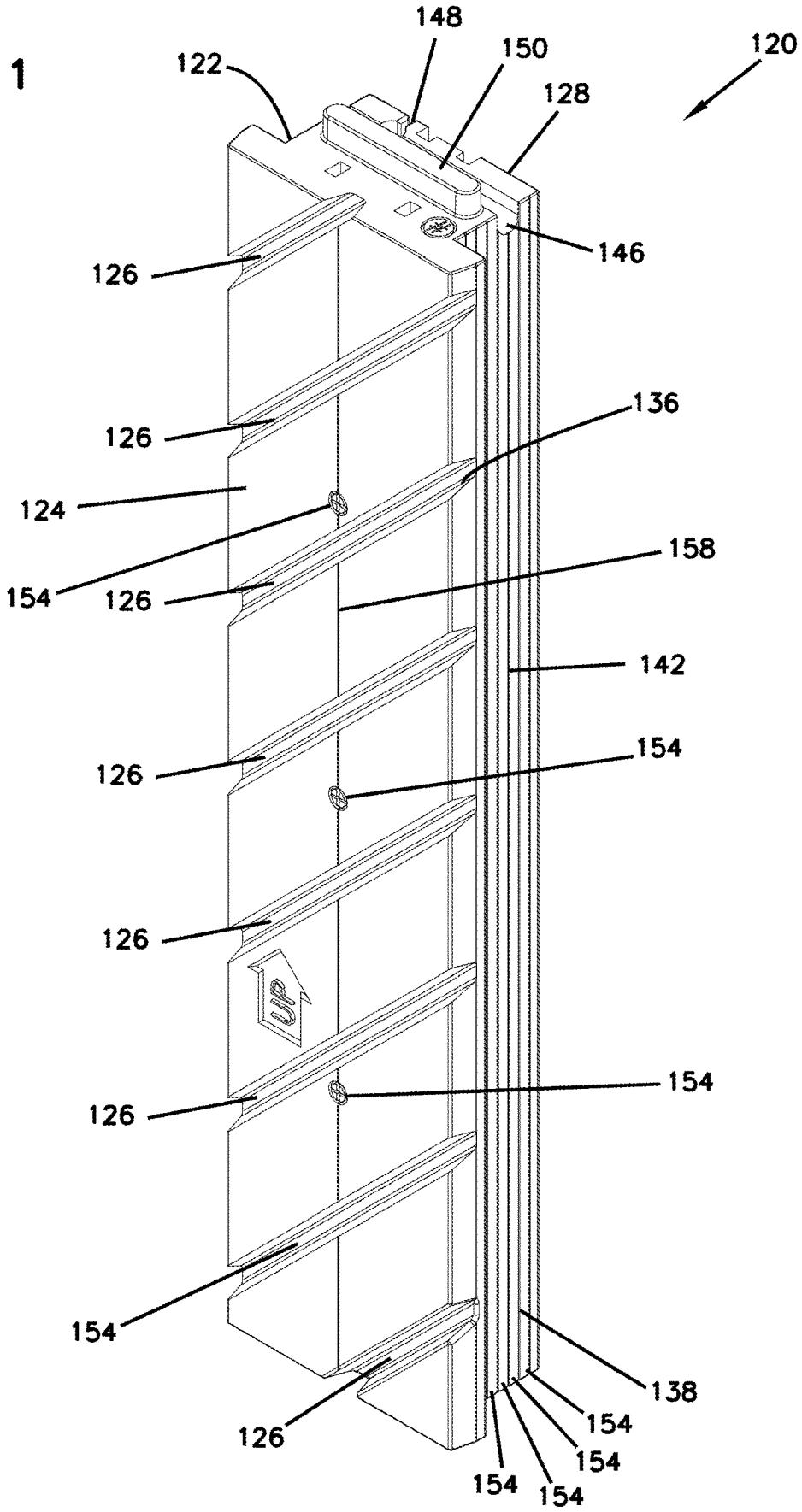
FIG. 1 is a perspective view of an insulation unit according to the principles of the present invention.
Figure 2:
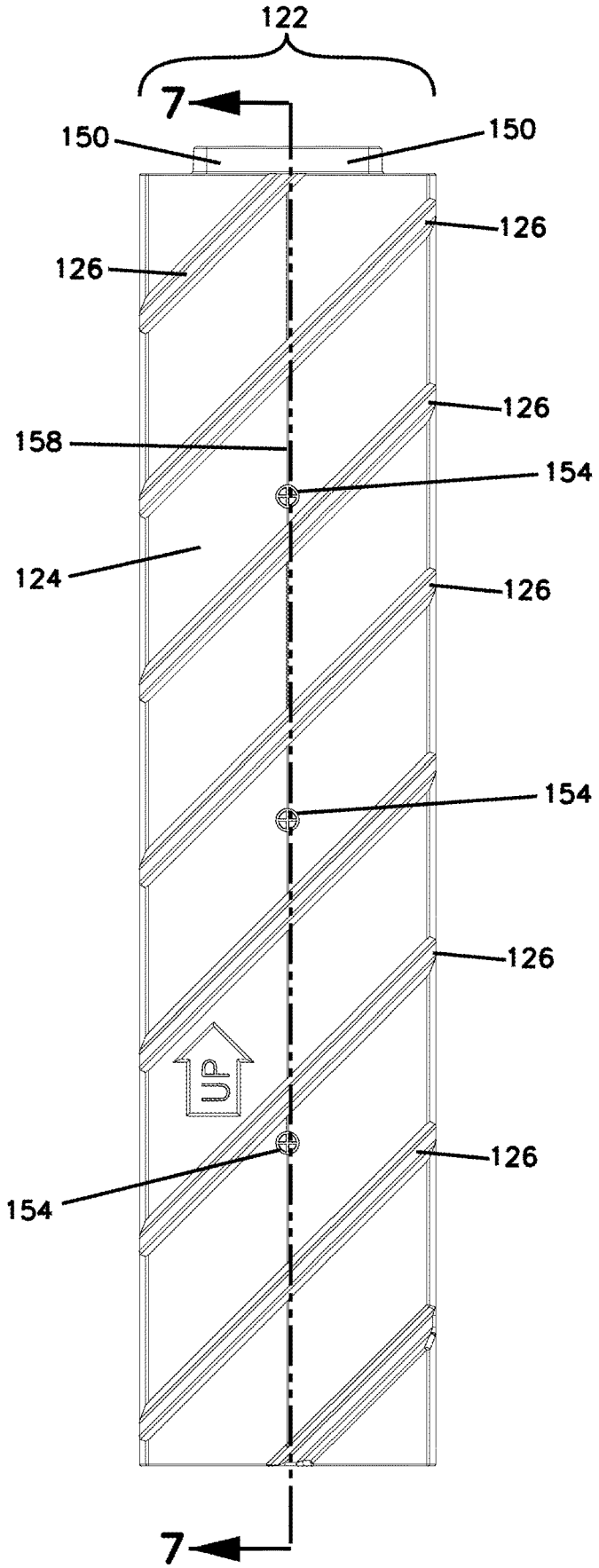
FIG. 2 is a front elevational view of the insulation unit shown in FIG. 1.
Figure 3:
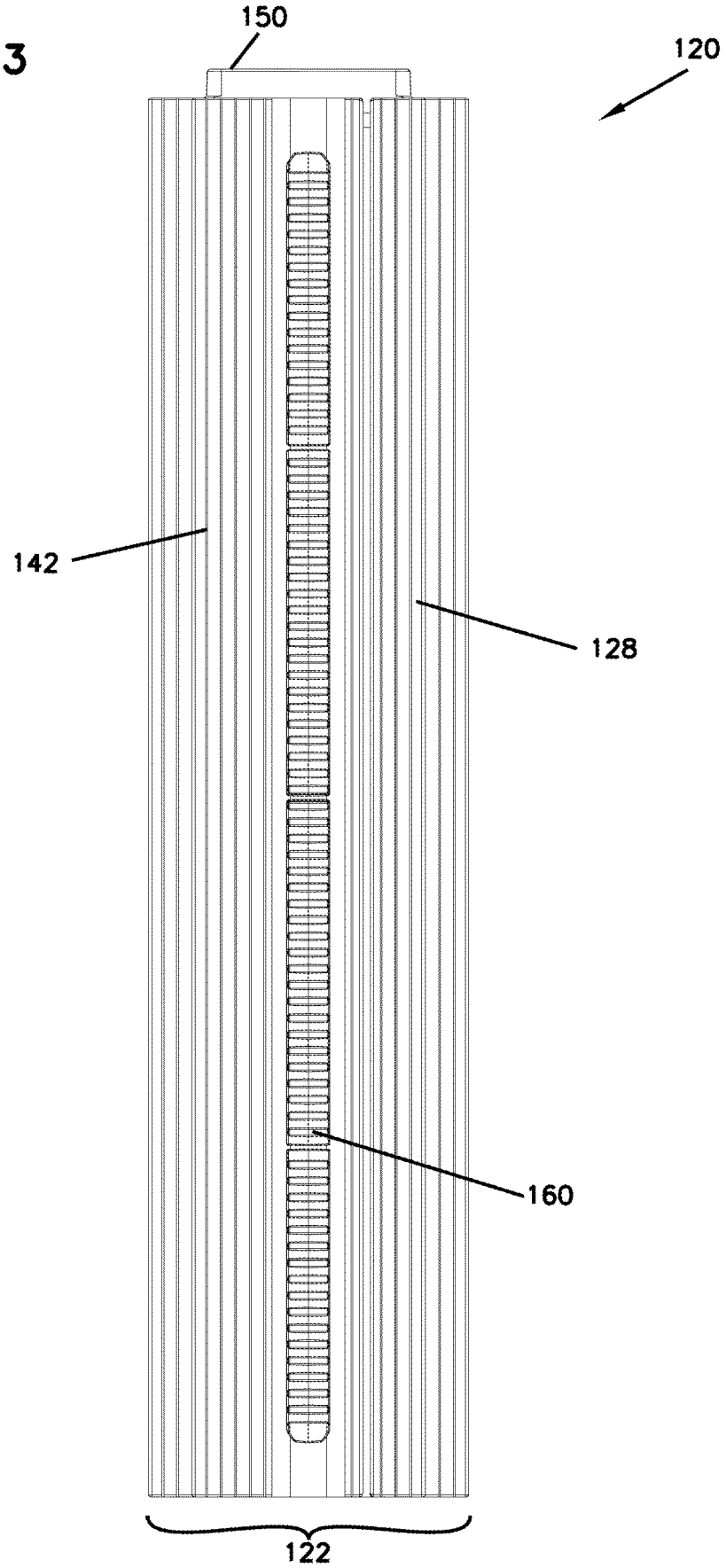
FIG. 3 is a rear elevational view of the insulation unit shown in FIG. 1.
Figure 4:
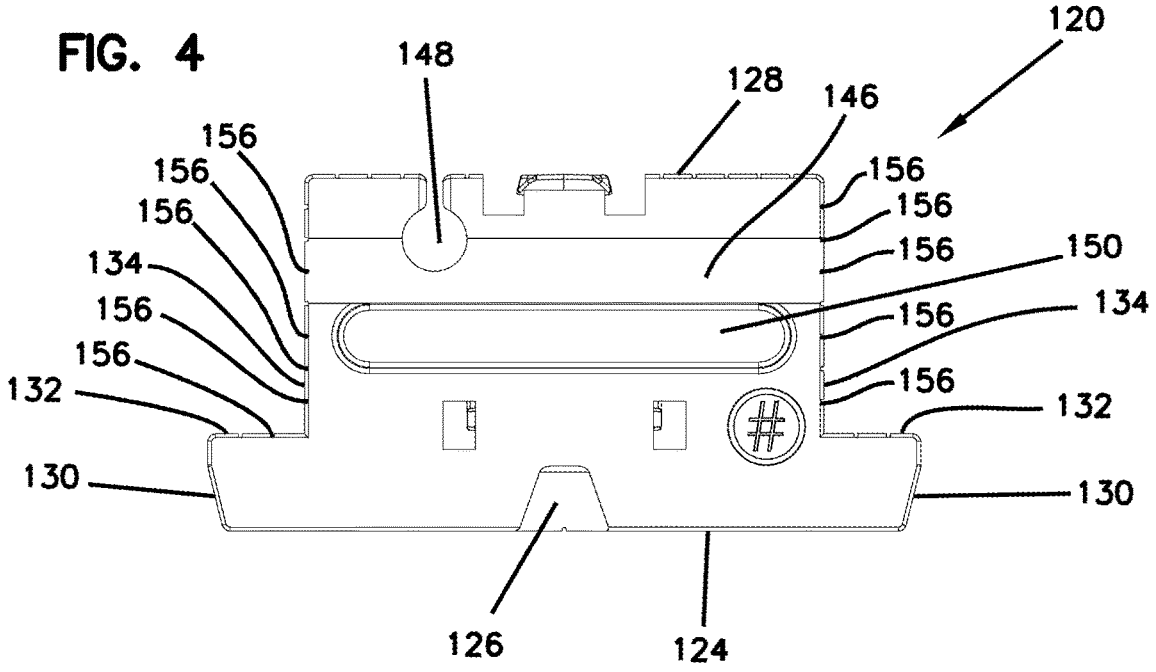
FIG. 4 is an end view of a first end of the insulation unit shown in FIG. 1.
Figure 5:
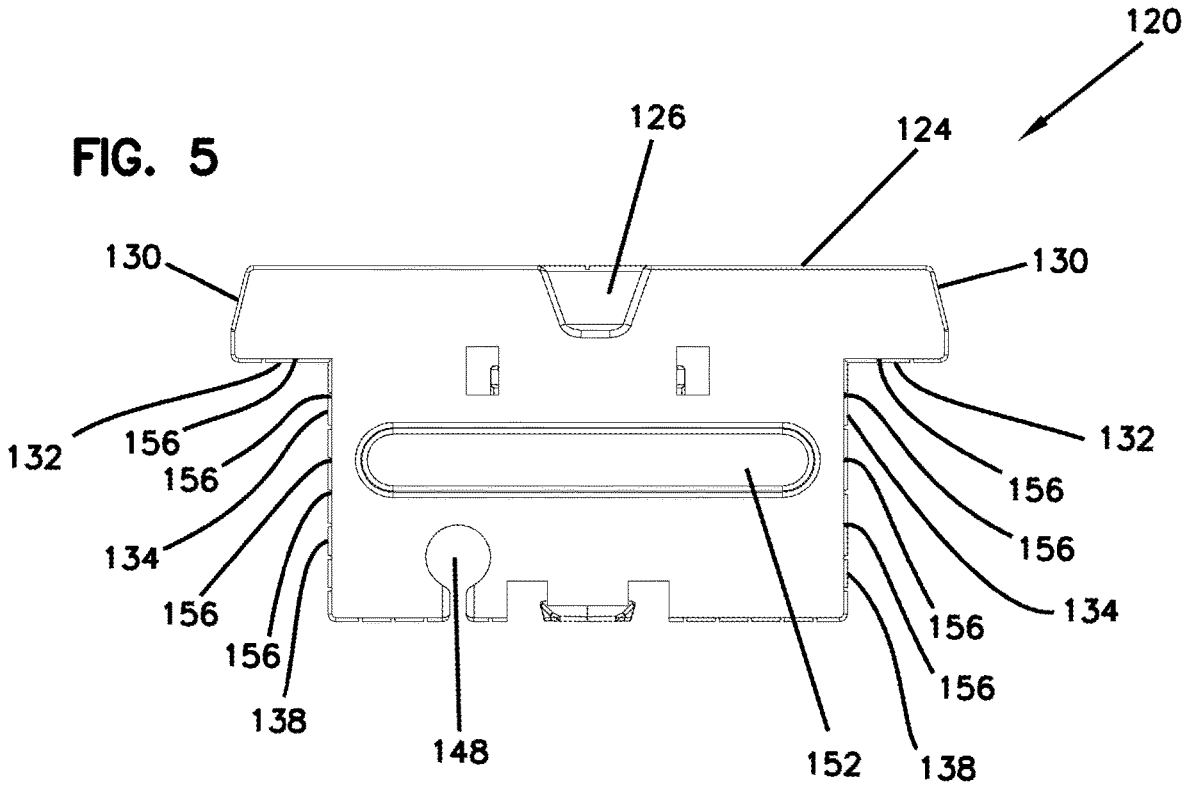
FIG. 5 is an end view of a second end of the insulation unit shown in FIG. 1.

Referring now to FIGS. 1-7, there is shown an insulated mounting unit (120) utilized in a wall system (100) shown in FIGS. 13-18, as explained hereinafter. Referring again to FIGS. 1-7, the insulated mounting unit (120) includes an insulating molded foam portion (122) with a stud element (160) embedded within the foam portion (122). The stud (160) extends longitudinally and provides support and mounting surfaces. The insulation unit (120) includes a widened first portion includes a first face (124) having parallel angled channels formed along the first face. The first face (124) also includes mounting marks (154) providing an indication of where fasteners may be attached to extend through the embedded stud element (160). A narrower second portion includes an opposite face (128) with ridges (142) that form gaps to provide capillary action if needed. The first face (124) is wider than the second face (128) and forms shoulder surfaces (132) and (134) that receive conventional planar insulation elements as explained hereinafter. In one embodiment, a widened front portion is 5.5 inches wide, the second portion is 4 inches wide, the insulation has a depth of 2.75 inches and a height of 24 inches. However, sizes may be utilized depending upon the application and requirements. Angled portions (130) extend at each lateral side of the first face and provide a pathway for air and water movement. The insulation units (120) have a generally longitudinal axis that typically extends vertically when the insulation units (120) are mounted. The insulation units (120) may be stacked upon one another and include a tongue (150) at one end and a complementary groove (152) at an opposite end that engage when the insulation units (120) are stacked to align vertically adjacent units (120). Horizontal channels (146) are formed in the top or bottom of insulation unit (120). The channels (146) form laterally extending horizontal chases when the insulation units (120) are stacked for routing wiring and other elements horizontally as may be necessary.

Chases (148) provide spaces for routing wiring and other elements as necessary vertically. Mounting and cutting guides (158) provide for a center alignment should fasteners need to be extended through to engage the stud elements (160). Notches or slots (156) may also be formed vertically along the side portions (138). The slots and notches (156) generally extend vertically and provide for drainage or surfaces for application of adhesive to mount planar insulation elements, as explained hereinafter.

Figure 6:
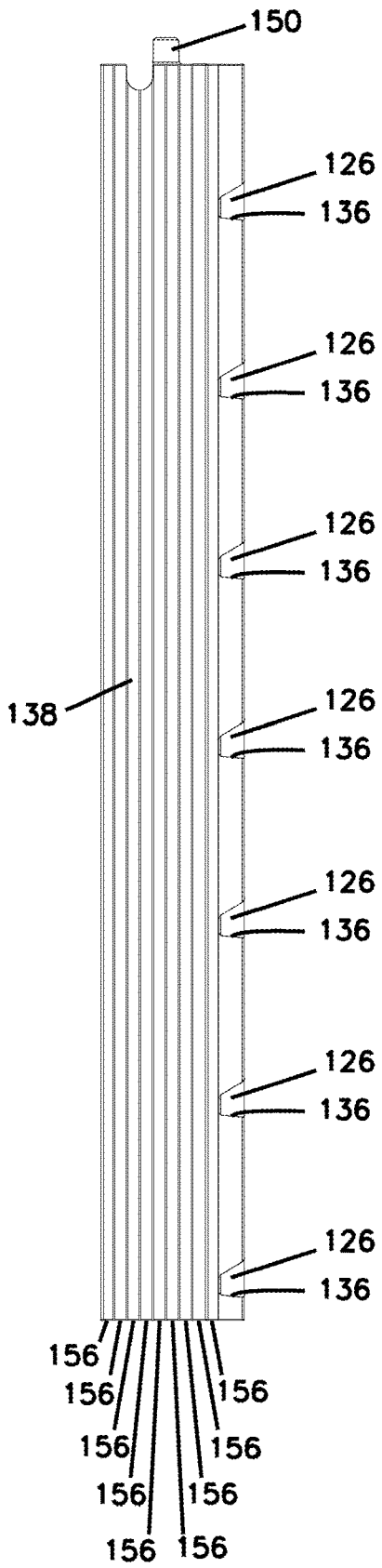
FIG. 6 is a side view of the insulation unit shown in FIG. 1.
Figure 7:
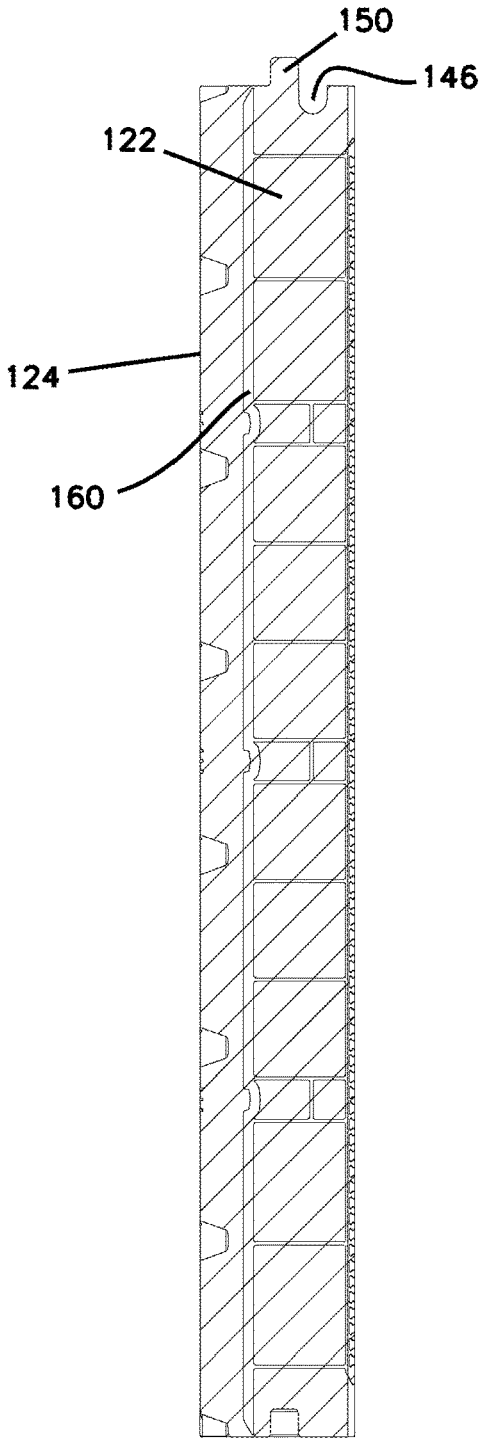
FIG. 7 is a sectional view thereof taken along line 7-7 of FIG. 2.
Figure 8:
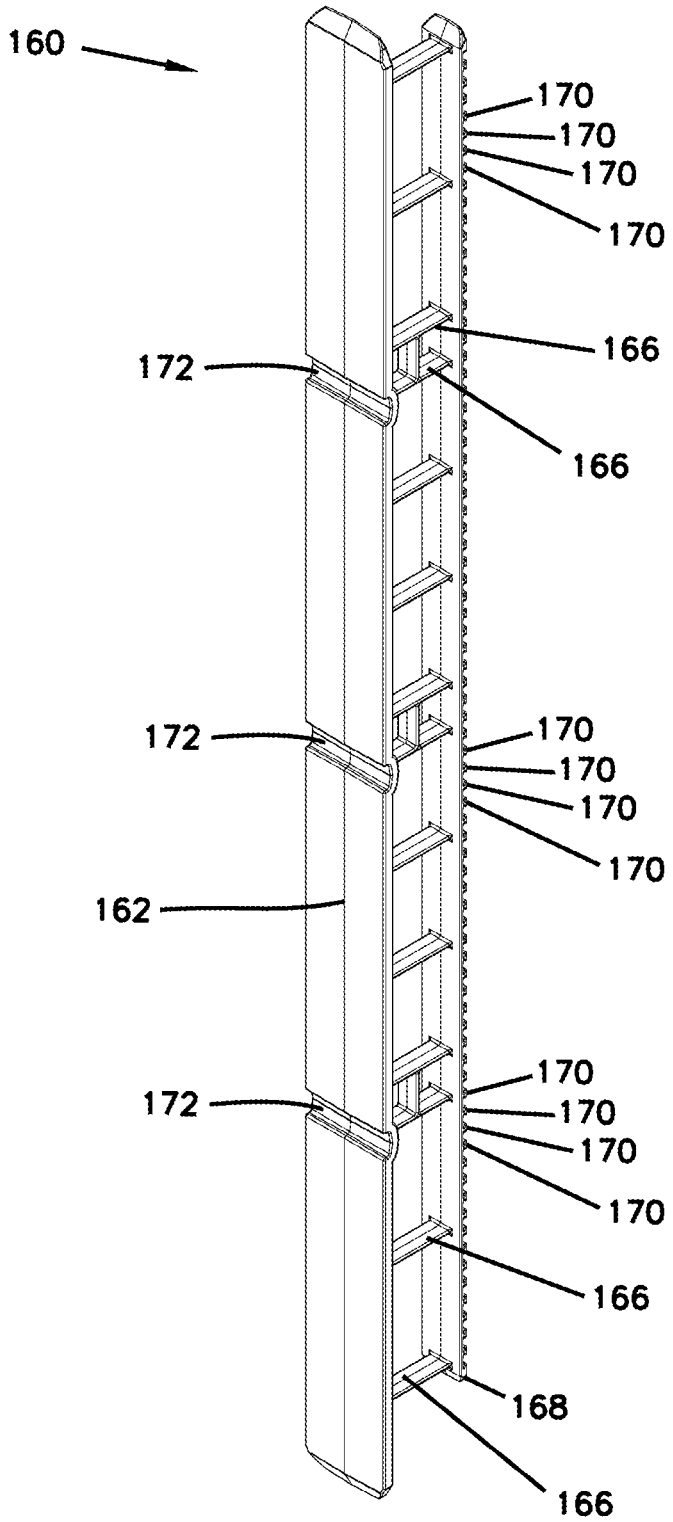
FIG. 8 is a perspective view of a stud element embedded in the insulation unit shown in FIG. 1.
Figure 9:
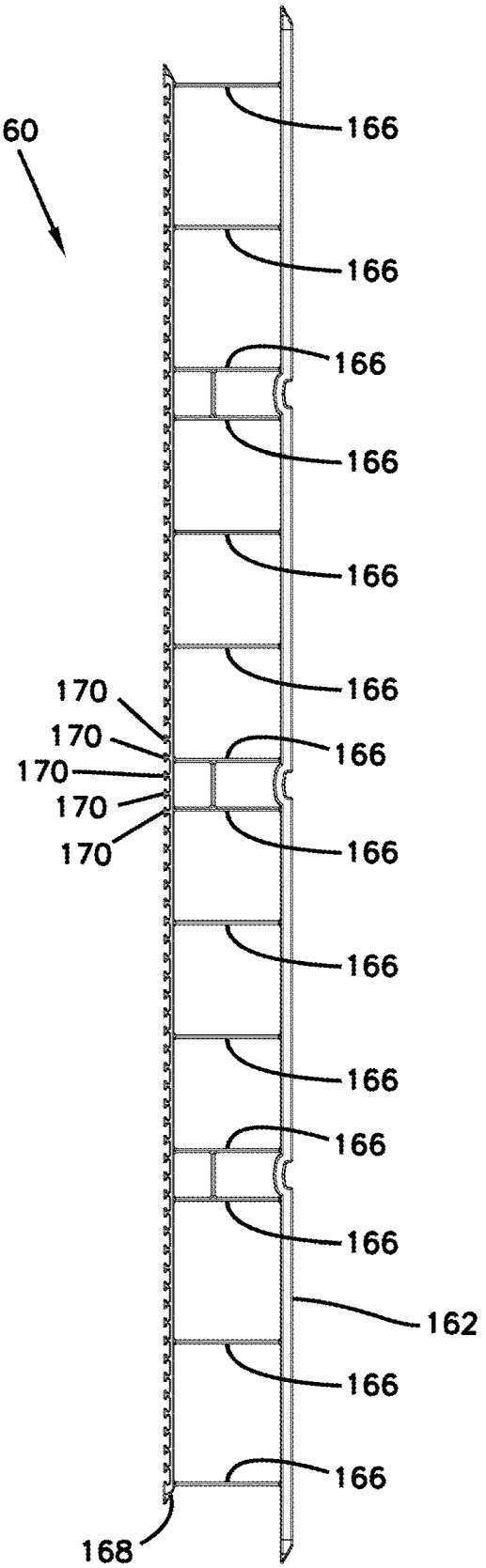
FIG. 9 is a side elevational view of the stud element shown in FIG. 8.
Figure 10:
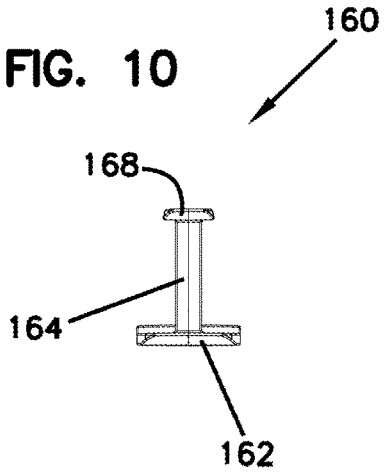
FIG. 10 is an end view of the stud element shown in FIG. 8.
Figure 11:
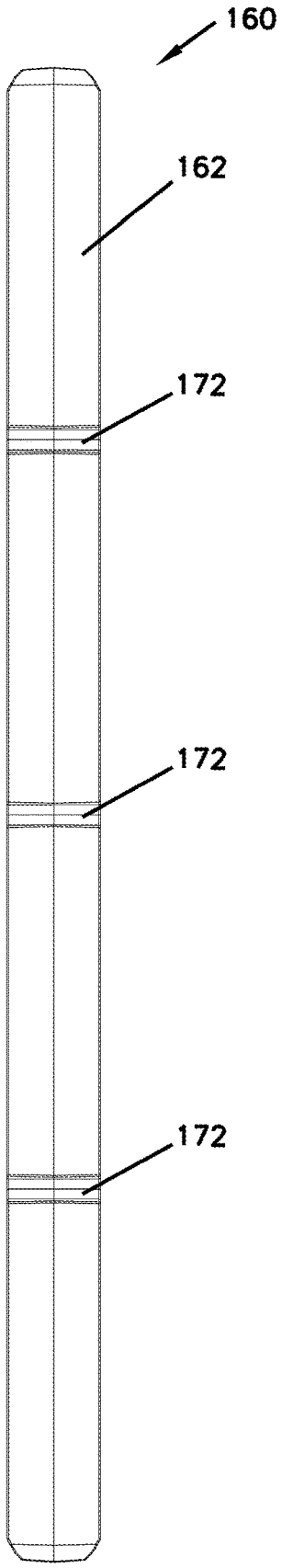
FIG. 11 is a top plan view of the stud element shown in FIG. 8.
Figure 12:
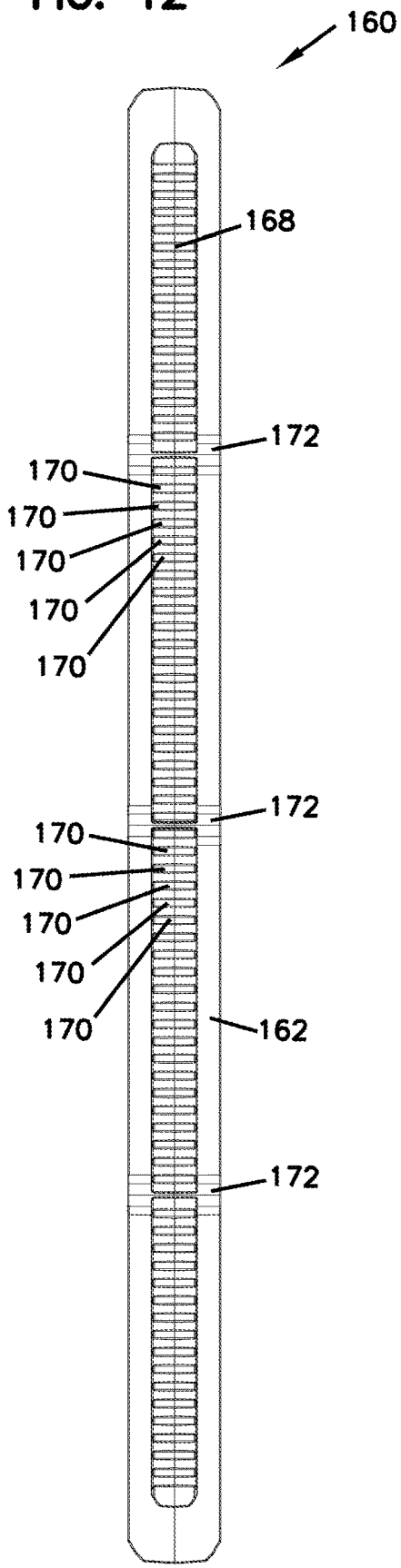
FIG. 12 is a bottom plan view of the stud element shown in FIG. 8.
Figure 13:
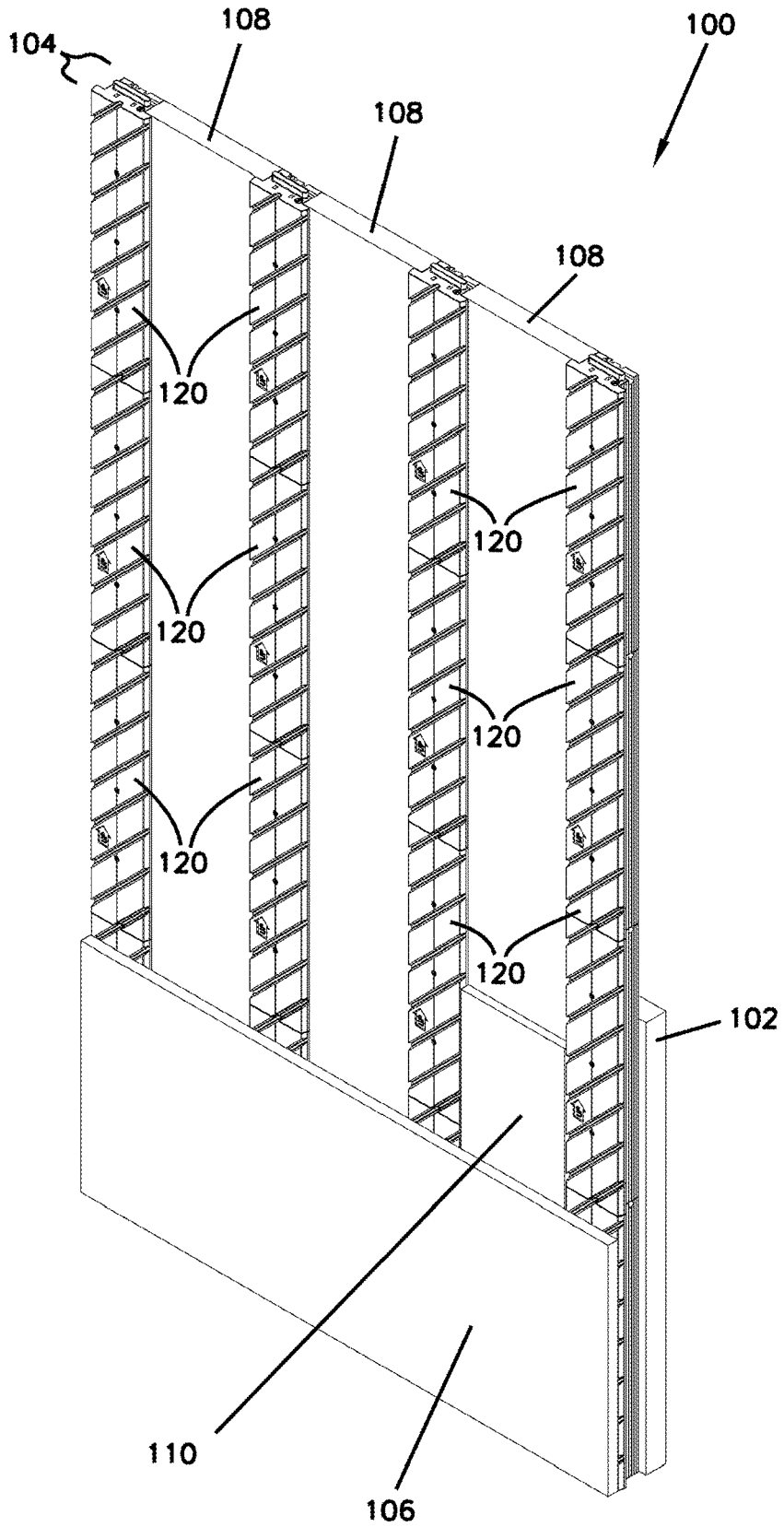
FIG. 13 is a top perspective view of a wall system including the insulation unit shown in FIG. 1 with portions removed for clarity.
Figure 14:
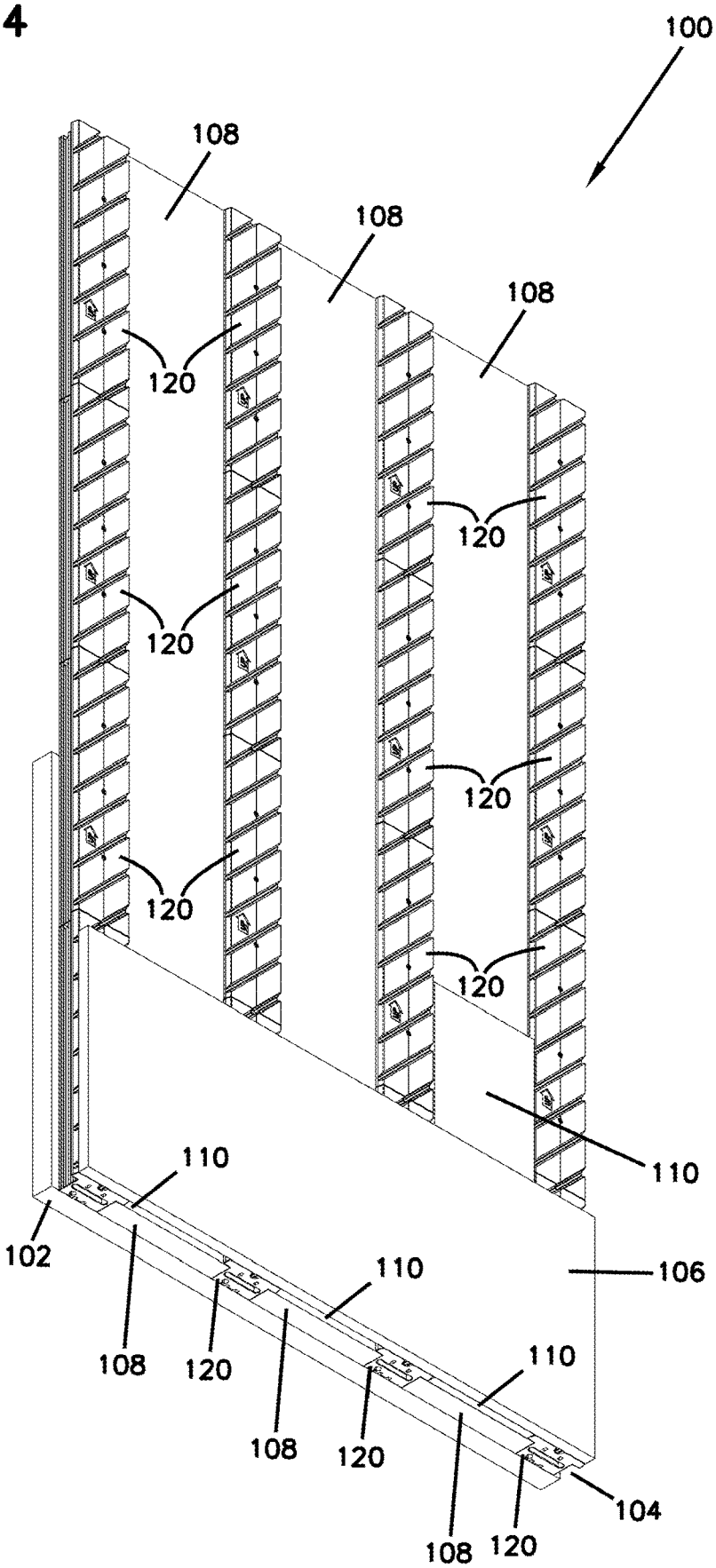
FIG. 14 is a bottom perspective view of the wall system shown in FIG. 13.
Figure 15:
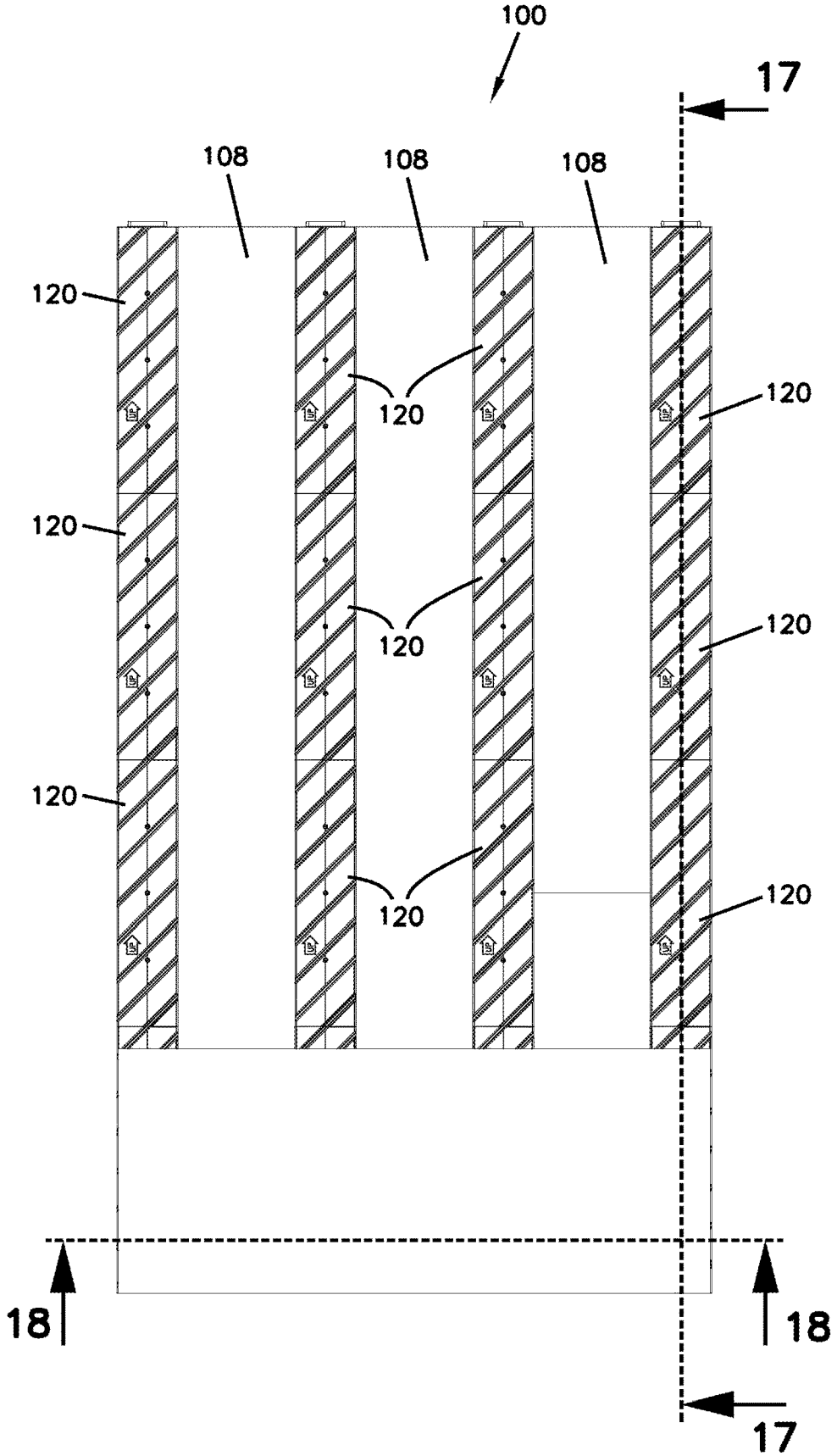
FIG. 15 is a front elevational view of the wall system shown in FIG. 13.
Figure 16:
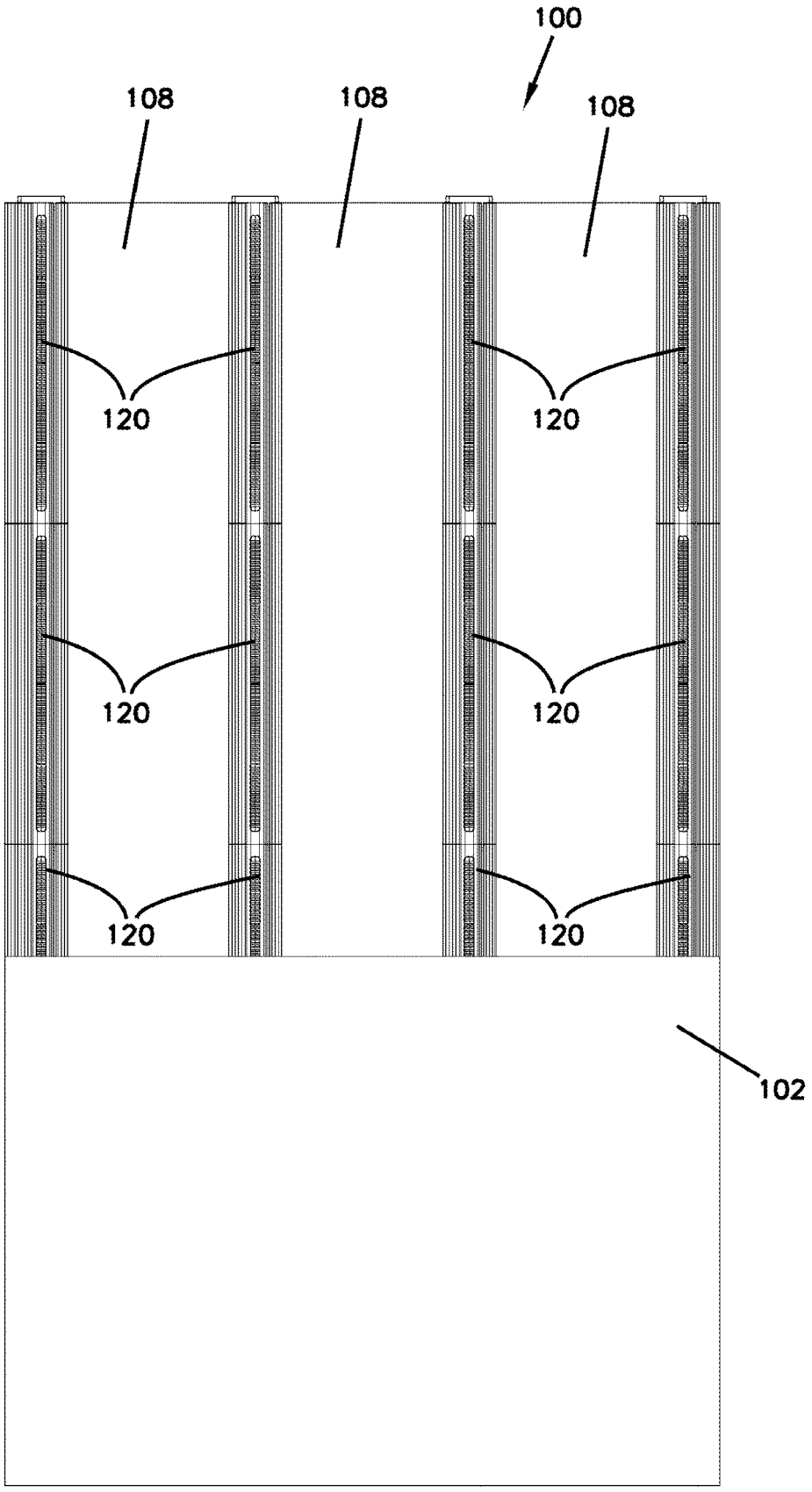
FIG. 16 is a rear elevational view of the wall system shown in FIG. 13.
Figure 17:
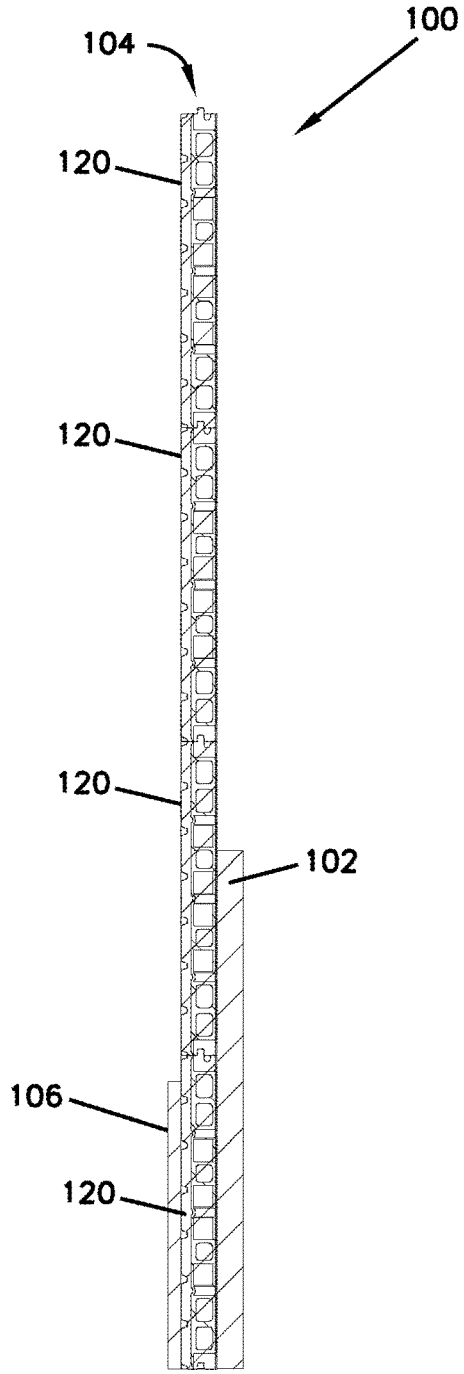
FIG. 17 is a side sectional view taken along line 17-17 of FIG. 15.

The channels (126) generally extend at an oblique angle relative to the vertical axis and provide a plurality of slanted channels extending across the first face (124) of the insulation units (120). The channels (126) have a chamfered lower surface (136), such as shown in FIGS. 6 and 7, that provides for water to be directed generally outward and prevents water from moving into the wall. In this manner, damage due to moisture is minimized or eliminated.

Referring now to FIGS. 8-12, the stud element (160) is a light weight molded element that provides internal support for the insulation units (120). The stud (160) is an elongate element that extends generally along the longitudinal axis of the insulation unit (120). The mounting stud (160) has a somewhat "H" shaped cross section with a first planar portion (162) and a second planar portion (168) joined by a center connecting portion (164). The center connecting portion (164) includes connecting ribs (166) that provide openings through which insulation extends to provide greater interaction for the stud (160). The foam of the foam portion extends through the openings and provide an interlocking engagement between the foam portion (122) and the stud (160). The first portion (162) includes internal channels (172) extending laterally transverse to the longitudinal axis. The transverse channels (172) form segments (180) in the first portion (162) and provide greater flexing for the stud (160) and reaction to expansion and contraction of components. The second portion (168) includes ridges (170) extending transverse to the longitudinal axis of the mounting unit (160). The ridges (170) may extend through the second face of the insulation unit (120) and provide for receiving mounting hardware or application of adhesive. It can be appreciated that the stud unit (160) eliminates a thermal connection through the insulation unit (120) and provides for receiving screws, nails or other fasteners, as well as for having adhesive mount to the exposed ridges (170) of the second portion (168) for secure mounting. Adhesive holds the insulation units in tension and eliminate any shrinkage of the insulation units (120). As the insulation units (120) do not shrink when glued in place along the surface (132), gaps do not form and the need for tape, which may fail, to cover gaps is eliminated. The stud (160) may be a molded plastic element with low thermal conductivity. This configuration eliminates a thermal conducting path extending from front to rear through the insulation unit (120) that would undermine the insulating properties of the insulation unit (120).

Referring now to FIGS. 13-18, a wall system (100) incorporates the insulation units (120) to achieve an insulated wall system. The wall system (100) includes a structural wall (102), which is only partially shown for clarity. The structural wall may be a masonry wall or a wood frame wall or other conventional construction. An insulation layer (104) mounts to the structural wall (102) and includes insulation units (120) spaced apart and used in conjunction with planar insulation elements (108). Supplemental insulation panels (110) may also be utilized between the insulation units (120) to provide even greater R-value if needed. A finishing layer (106) is typically placed on the opposite side of the insulation layer (104) against the front faces (124) of the insulation units (120). It can be appreciated that further insulation layers may be added against the insulation layer (104) and intermediate the structural wall (102) and/or the finishing layer (106). It can also be appreciated that the finishing layer (106) may be paneling, drywall or siding. For some climates and applications a rain shield is added for protection against the elements. The types and number of layers will depend upon the climate and application of the building.

Figure 18:
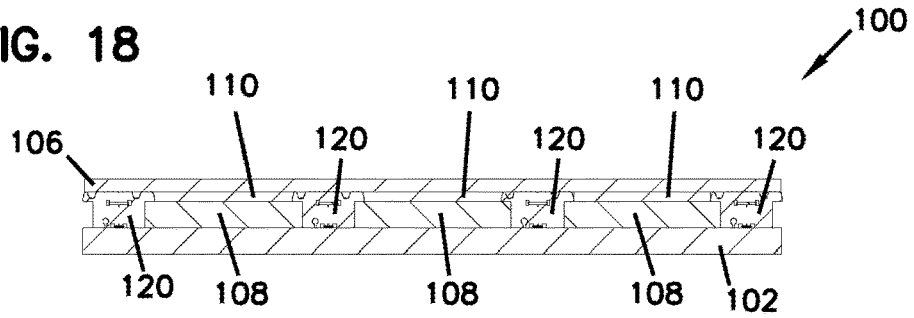
FIG. 18 is a bottom sectional taken along line 18-18 of FIG. 15.

As shown most clearly in FIG. 18, the insulation units (120) have shoulder surfaces (132) and (134) that form a right angle for receiving a corner of one of the planar insulation elements (108). Moreover, the gaps (142) and the ridges (170) of the mounting elements (160) provide for application of adhesive for securely mounting the various elements to the insulation units (120). It can also be appreciated that the finishing layer (106) may be mounted to the insulation units (120) with fasteners extending through to engage the studs (160), but do not extend entirely through the depth of the wall system (100).

The slanted channels (126), the angled portions (130) forming channels proximate the first face as well as the ridges (142) and the notches (156) provide pathways that allow for capillary breaks, drainage and ventilation to extend vertically within the wall system. Moreover, the channels (126) provide angled cross ventilation in addition to air being moved across and upward through the wall system (100). The same angled channels (126), along with the spaces formed by the angled portions (130) and the ridges (142) and notches (156) provide for moisture to flow downward under the force of gravity within the wall system. The lowermost insulation units (120) and corresponding insulation panels (108) or (110) generally are installed with a gap at the bottom of the wall and the uppermost insulation units (120) and corresponding insulation panels (108) or (110) generally are installed with a gap at the top of the wall system (100). The gaps promote faster drying increase air movement. As air naturally rises as it warms, the wall system (100) pulls fresh air at the bottom. For outer walls, this air naturally heats up with the sun warming and creates a rising warm air stream that promotes quick drying. The air will be vented to the outside at the top of the wall system (100). In this manner, the wall system (100) is able to provide internal ventilation and to eliminate internal moisture buildup within the wall system (100). It can also be appreciated that the materials used in the insulation layer (104) are water and mold resistant and will not rot. It can also be appreciated that the insulation system (100) achieves a superior insulating properties and eliminates thermally conductive pathways extending through the insulation layer (104).

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An insulation device comprising:

an insulating element extending along a longitudinal direction, comprising a first portion proximate a second portion, the first portion having a width greater than the second portion, the first portion having a first face, the first face having a plurality of channels formed into the first face and extending across the first face of the insulating element, the plurality of channels extending obliquely to the longitudinal direction, wherein each of the plurality of channels comprises a chamfered upper surface and a chamfered lower surface; and a longitudinally extending mounting member embedded in the insulating element.

2. The insulation device according to claim 1, wherein the plurality of channels comprises a plurality of parallel channels.

3. The insulation device according to claim 1, wherein a first surface of each of the plurality of channels extends from a bottom of each channels to the first face at an oblique angle to the first face.

4. The insulation device according to claim 1, wherein a rear surface of the first portion of the insulating element and side surfaces of the second portion of the insulating element are perpendicular.

5. The insulation device according to claim 1, wherein the mounting member has a longitudinal center section and a first section extending laterally from a first edge of the center section and a second section extending laterally from a second edge of the center section.

6. The insulation device according to claim 1, wherein the first section of the mounting member comprises a planar first face having a plurality of transverse channels defining a plurality of first section segments.

7. The insulation device according to claim 1, wherein one of a top and bottom of each insulating element comprises a tongue and the other of the top and bottom of each insulating element comprises a complementary groove.

8. The insulation device according to claim 1, wherein one of a top and bottom of each insulating element comprises a channel extending substantially horizontally when mounted.

9. A wall insulation system comprising:

a plurality of the insulation devices according to claim 1; and a plurality of first insulation panels, wherein an edge of at least one said first insulation panel abuts a rear surface of the first portion and one side surface of the second portion of an adjacent said insulation device.

10. The wall insulation system according to claim 9, further comprising a second insulation panel intermediate two of the insulation devices and proximate one of the first insulation panels.

* * * * *